US012628935B2

(12) United States Patent
Williams

(10) Patent No.: US 12,628,935 B2
(45) Date of Patent: May 19, 2026

(54) WEARABLE TACTICAL ACCESSORIES

(71) Applicant: Tactical Women, LLC, Cincinnati, OH (US)

(72) Inventor: Terri L. Williams, Cincinnati, OH (US)

(73) Assignee: Tactical Women, LLC, Cincinnati, OH (US)

( * ) Notice: Subject to any disclaimer, the term of this patent is extended or adjusted under 35 U.S.C. 154(b) by 199 days.

(21) Appl. No.: 18/300,913

(22) Filed: Apr. 14, 2023

(65) Prior Publication Data

US 2024/0341452 A1 Oct. 17, 2024

(51) Int. Cl.
*A45F 3/02* (2006.01)
*A41D 13/015* (2006.01)

(52) U.S. Cl.
CPC ..... *A45F 3/02* (2013.01); *A41D 13/0151* (2013.01)

(58) Field of Classification Search
CPC ..... A41D 13/0151; A45F 2003/025; A45F 2004/006; A45F 2004/023; A45F 3/02
USPC ..... 224/578–583, 602–605, 660
See application file for complete search history.

(56) References Cited

U.S. PATENT DOCUMENTS 2,413,580 A 12/1946 Perry
2,672,263 A * 3/1954 Alber ..... A45F 5/00 224/602
3,799,413 A * 3/1974 McBain ..... A45F 3/12 224/264
4,493,115 A 1/1985 Maier et al.
4,564,008 A 1/1986 Donahoo
4,878,606 A * 11/1989 Miller ..... A45F 3/14 224/625
D304,977 S 12/1989 Pappas
5,246,153 A 9/1993 Beletsky
5,400,935 A 3/1995 Farmer
D386,613 S * 11/1997 Terzian ..... D3/289
D414,331 S 9/1999 Lichtenberger
D455,548 S 4/2002 Cragg
6,886,726 B1 * 5/2005 O'Hare ..... A45F 3/02 224/625
D529,714 S 10/2006 Rabinovitch
D557,496 S 12/2007 Gonthier
7,909,214 B2 * 3/2011 Gold ..... A45F 3/02 224/625
9,121,666 B2 9/2015 Ferrante
9,476,675 B1 10/2016 Manglos
D770,172 S 11/2016 Crouch
11,044,985 B2 6/2021 Swaggart
2007/0205237 A1 * 9/2007 Machens ..... A01D 34/902 224/264
2008/0006668 A1 * 1/2008 Nowacki ..... A45F 5/021 224/625
2018/0087870 A1 3/2018 Black
2019/0082813 A1 3/2019 Dilanchyan
(Continued)

FOREIGN PATENT DOCUMENTS

GB 2251544 A 7/1992

*Primary Examiner* — Scott T McNurlen
(74) *Attorney, Agent, or Firm* — Dinsmore & Shohl LLP

(57) ABSTRACT

A wearable tactical accessory includes a shoulder harness, a pouch, a strap, and a recoil pad. The shoulder harness includes one or more pad pockets. The strap removably couples the shoulder holster and the pouch. The recoil pad is sized to be removably positioned within the one or more pad pockets.

18 Claims, 9 Drawing Sheets

(56) References Cited

U.S. PATENT DOCUMENTS

| | | | | |
|---|---|---|---|---|
| 2019/0191857 | A1* | 6/2019 | Nesbit | A45F 4/02 |
| 2020/0069019 | A1* | 3/2020 | Sloma | A45C 13/1076 |

* cited by examiner

WEARABLE TACTICAL ACCESSORIES

TECHNICAL FIELD

The present specification generally relates to wearable tactical accessories and, more specifically, to wearable tactical accessories having a removable recoil pad or recoil pads.

BACKGROUND

Sport shooting, such as target shooting, skeet shooting, hunting, or the like, often includes the use of a firearm having a shoulder stock, such as a rifle or shotgun, which is placed against a user's shoulder for support during shooting. When firing firearms, especially larger caliber firearms, the forward momentum of the projectile or bullet can cause a significant recoil effect which impacts the user. Such recoil impacts may be uncomfortable for a user to absorb. Accordingly, recoil pads exist in the market, which assist in absorbing recoil impacts, which may result in a more enjoyable and comfortable experience.

However, existing recoil pads are often large, clumsy, and uncomfortable to use. In particular, recoil pads may be particularly uncomfortable for women, who's anatomy may make it difficult for traditional pad to sit comfortably against the user's upper chest and shoulder.

Moreover, sport shooting may include carrying of bullets, gun carriers, targets, etc. Accordingly, carrying an additional item such as a shooting pad may be inconvenient.

Accordingly, a need exists for alternative wearable tactical accessories, which incorporate the functionality of a shooting pad, while increasing comfort and without overburdening a user.

SUMMARY

In one embodiment, a wearable tactical accessory includes a shoulder harness, a pouch, a strap, and a recoil pad. The shoulder harness includes one or more pad pockets. The strap removably couples the shoulder holster and the pouch. The recoil pad is sized to be removably positioned within the one or more pad pockets.

In another embodiment, a wearable tactical accessory includes a shoulder harness, a pouch, a strap, and a recoil pad. The shoulder harness includes one or more pad pockets. The strap removably couples the shoulder holster and the pouch via one or more buckles. The recoil pad is sized to be removably positioned within the one or more pad pockets.

In yet another embodiment, a wearable tactical accessory includes a shoulder harness, a pouch, a strap, and a recoil pad. The shoulder harness includes one or more pad pockets. The pouch includes a divider dividing a volume of the pouch into a first sub volume and a second sub volume. The strap removably couples the shoulder holster and the pouch. The recoil pad is sized to be removably positioned within the one or more pad pockets.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to wearable tactical accessories. In particular, the wearable tactical accessories as disclosed herein generally include a shoulder harness, a pouch, and a strap that couples the shoulder harness to the pouch. In embodiments, the shoulder harness includes one or more pad pockets which allows a user removably insert a recoil pad. The recoil pad may be smaller than traditional recoil pads and may be positioned by the shoulder harness to provide improved comfort. Moreover, as the recoil pad is removable, the wearable tactical accessory allows for improved versatility and use. Various embodiments of the wearable tactical accessory and benefits will be described in more detail herein.

Figure 1A:
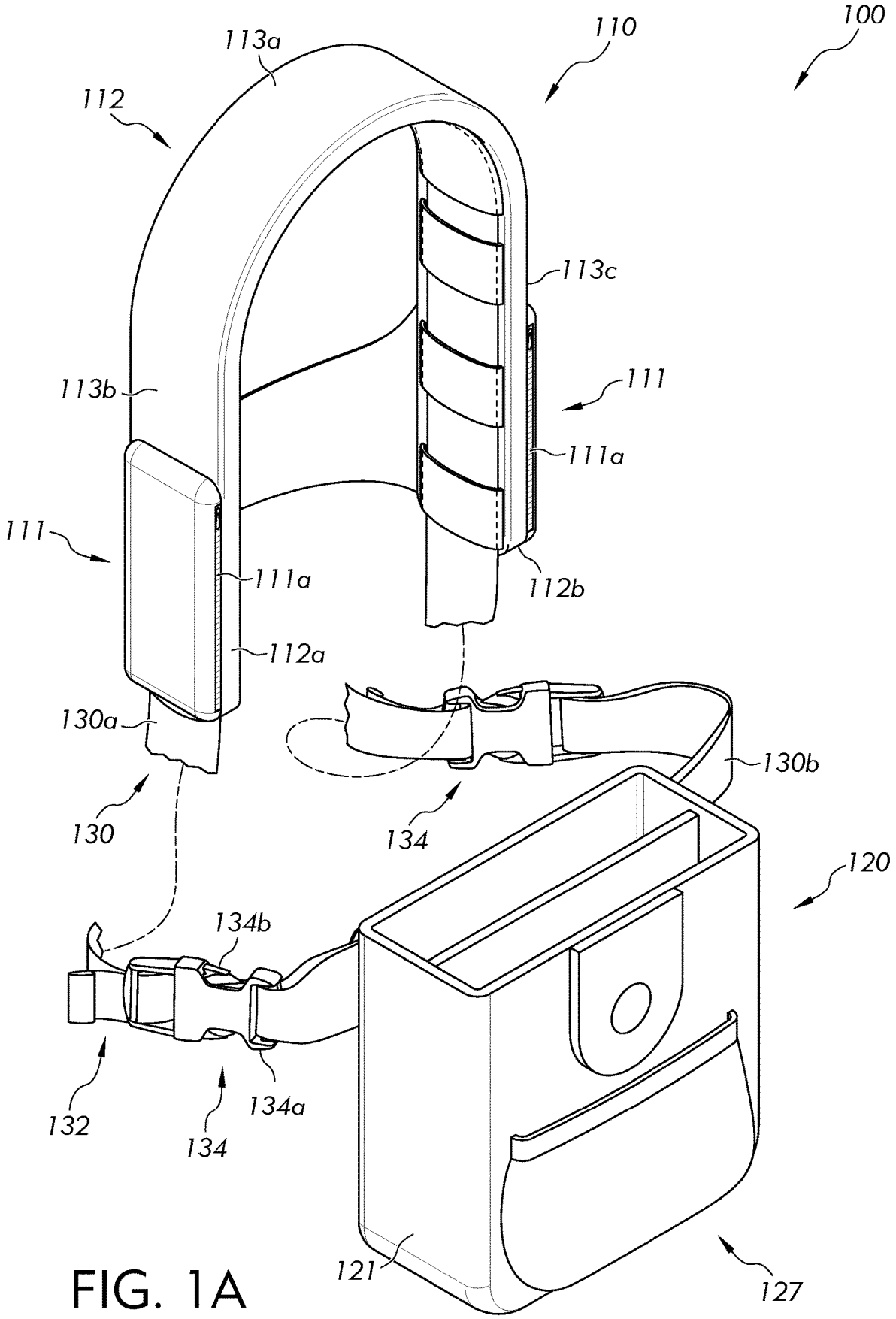
FIG. 1A depicts a front perspective view of a wearable tactical accessory including a shoulder harness, a pouch, and a strap, according to one or more embodiments shown and described herein.
Figure 1B:
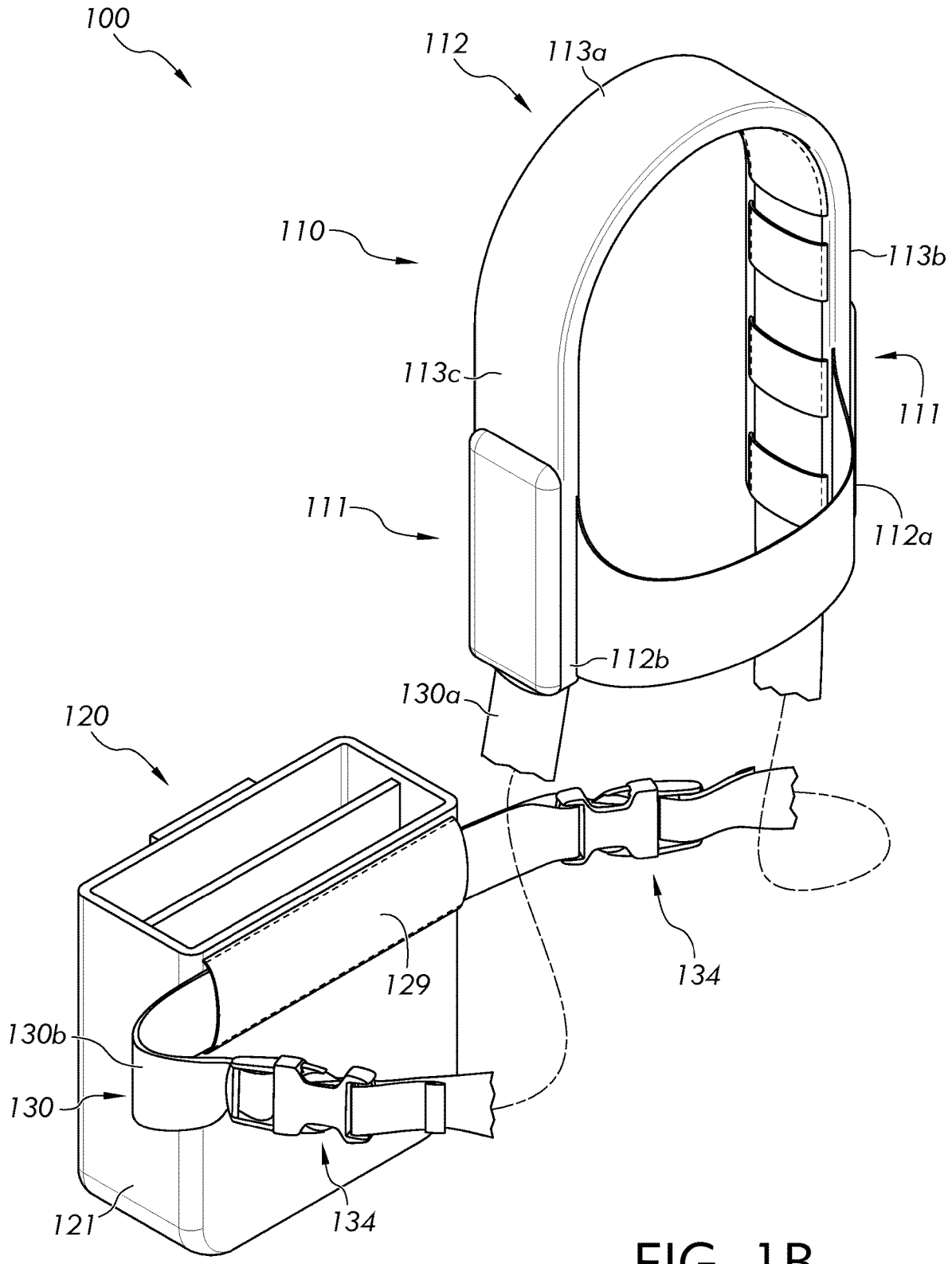
FIG. 1B depicts a back perspective view of the wearable tactical accessory of FIG. 1B, according to one or more embodiments shown and described herein.
Figure 2B:
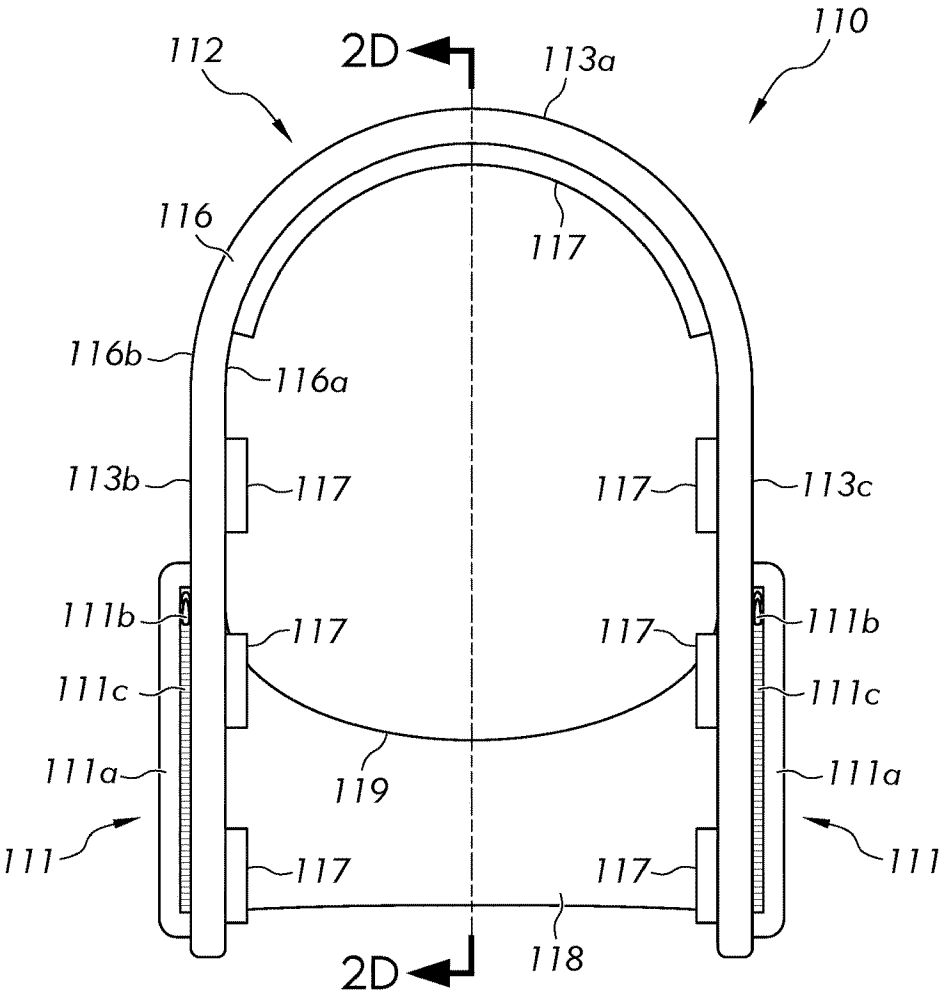
FIG. 2B depicts a first side view of the shoulder harness of FIG. 2A, according to one or more embodiments shown and described herein.
Figure 2A:
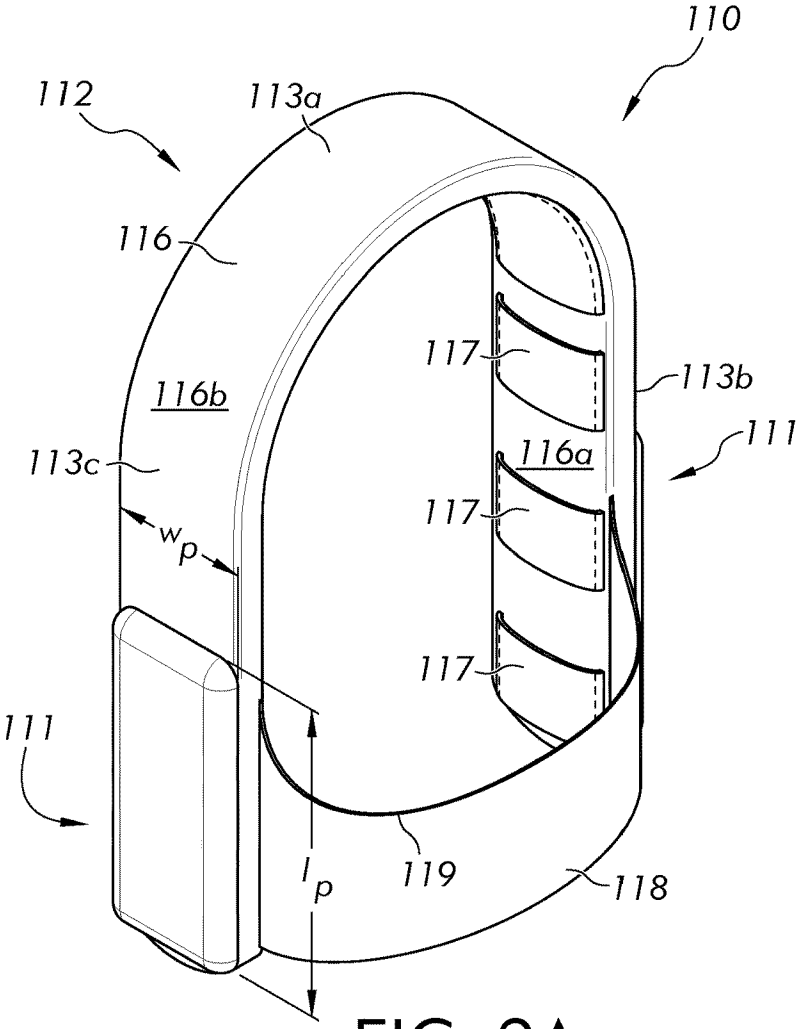
FIG. 2A depicts a perspective view of a shoulder harness such as may form part of the wearable tactical accessory of FIG. 1A, according to one or more embodiments shown and described herein.
Figure 2D:
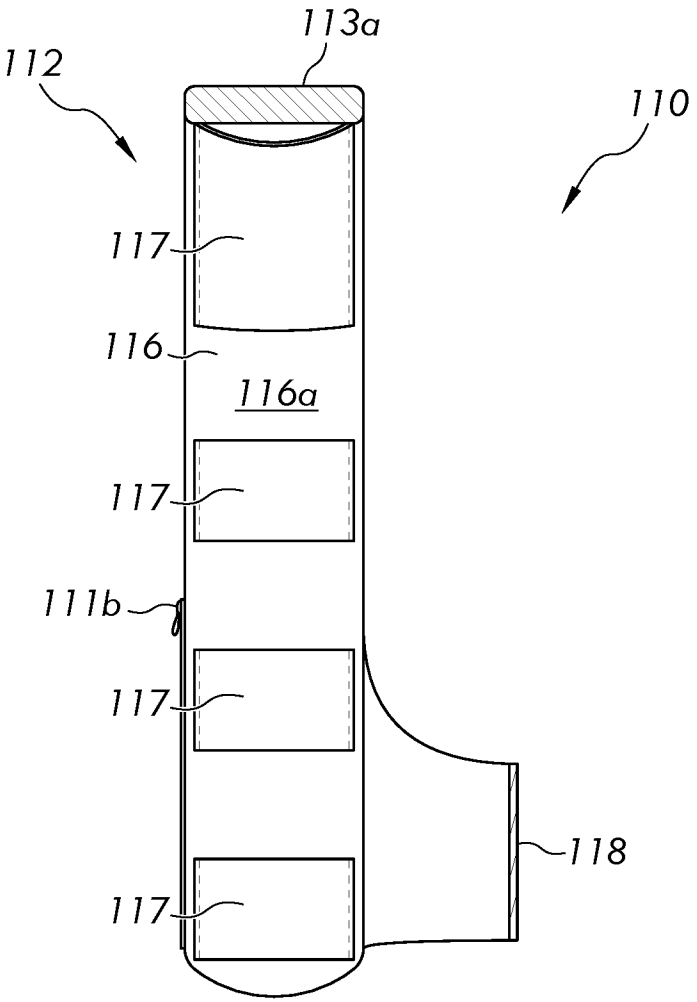
FIG. 2D depicts a cross-sectional view of the shoulder harness taken along 2D-2D of FIG. 2B, according to one or more embodiments shown and described herein.
Figure 2C:
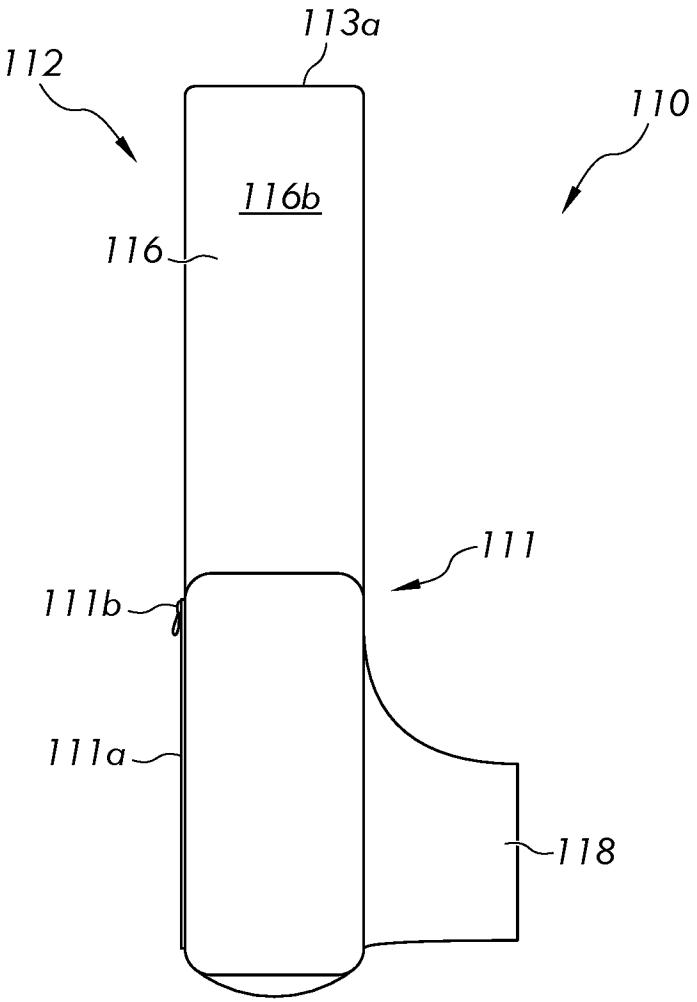
FIG. 2C depicts a front view of the shoulder harness of FIG. 2A, according to one or more embodiments shown and described herein.
Figure 6A:
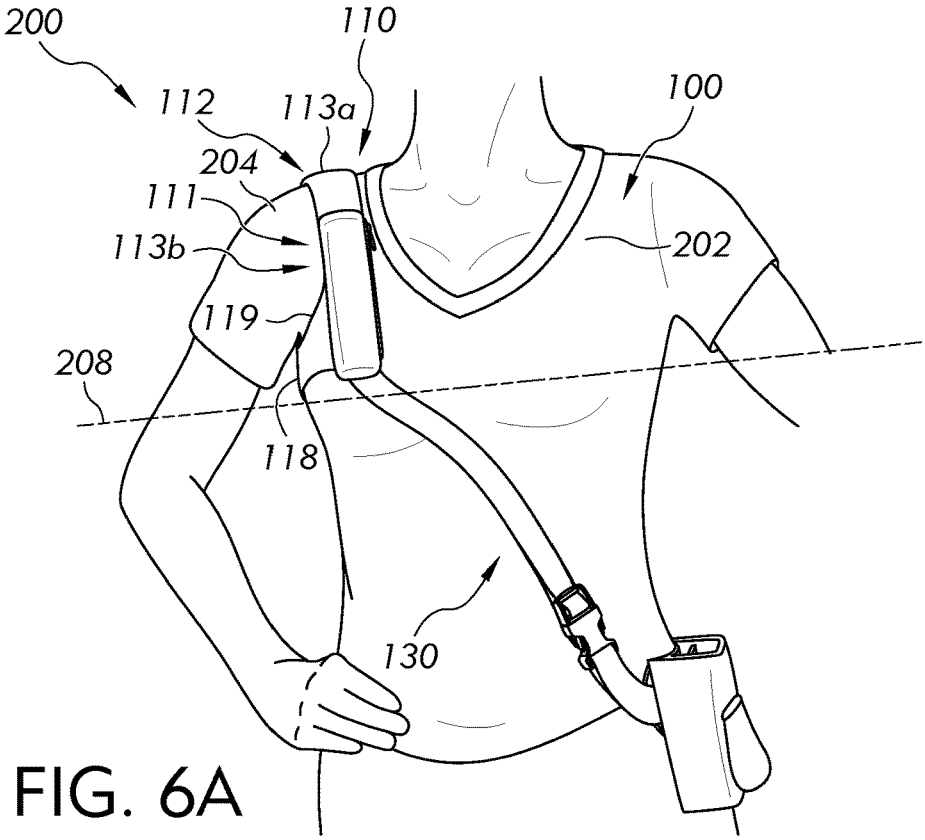
FIG. 6A schematically depicts a front view of a user wearing a wearable tactical accessory, according to one or more embodiments shown and described herein.
Figure 6B:
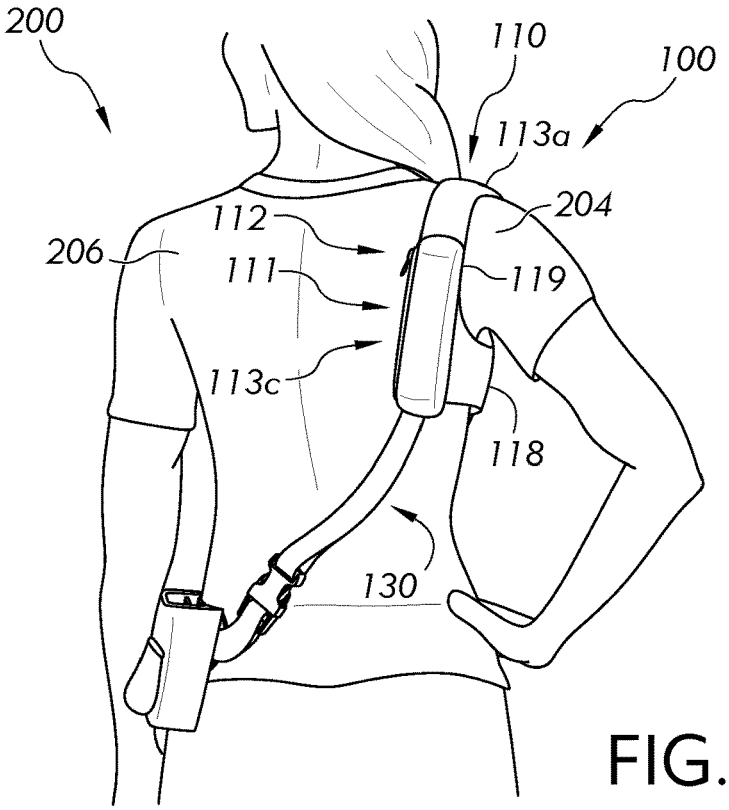
FIG. 6B schematically depicts a back view of the user of FIG. 6A, according to one or more embodiments shown and described herein.

Referring now to FIGS. 1A and 1B, a wearable tactical accessory 100 is depicted. The wearable tactical accessory 100 may be worn by a user 200, such as illustrated in FIGS. 6A and 6B, similar to a cross-body bag, though as will be described in greater detail herein other wear styles are contemplated and possible. The wearable tactical accessory 100 generally includes a shoulder harness 110, a pouch 120 and a strap 130. It is noted that a wearable tactical accessory 100 may include additional components without departing from the scope of the present disclosure.

The shoulder harness 110 generally defines the portion of the wearable tactical accessory 100 which mounts to the user 200. As will be described in greater detail, the shoulder harness 110 may include one or more pad pockets 111 for removably receiving one or more recoil pads, such as may be used for shooting of firearms.

Forming the shoulder harness 110 may be a sleeve 112. The sleeve 112 may be go over a user's shoulder so as to extend from a first end 112*a* to a second end 112*b* so as to extend from chest to back on a user. Accordingly, the sleeve 112 may define a shoulder portion 113*a* configured to sit on top of the user's shoulder, a chest portion 113*b* which extends from the shoulder down onto a user's chest, and a back portion 113*c* which extends from the shoulder portion 113*a* down onto a user's back. In embodiments, the shoulder harness 110 may be ambidextrous such that the chest portion 113*b* and the back portion 113*c* are switched depending on the shoulder the user is wearing the wearable shoulder harness 110. In embodiments, the chest portion 113*b* and/or the back portion 113*c* may be configured to extend a distance of about 7 inches to about 12 inches from the shoulder an apex of the shoulder portion 113*a*. However, other lengths are contemplated and possible based on the dimensions of the user 200. Such dimensions may assist in preventing the sleeve 112 from overlying a largest dimension of, for example, a woman's bust line, which may increase comfort particularly for female or other users having breast tissue or breasts. In other embodiments, it is contemplated that a portion of the sleeve 112 may extend to or past one or more portions of the bust line of the user 200.

Referring now to FIGS. 2A-2D, the shoulder harness 110 is illustrated in isolation from the rest of the wearable tactical accessory 100. As noted above, the shoulder harness 110 may include the sleeve 112 which is configured to slidingly receive the strap 130. For example, the sleeve 112 may define a lumen or pathway therethough for receiving the strap 130, such as along the length of the sleeve 112. By passing the strap 130 through a length of the sleeve 112 the strap 130 may assist in conforming the shoulder harness 110 to the contours of the user 200. In embodiments, sleeve 112 may include a substrate 116 having an inner facing surface 116*a* (e.g., toward a body of a user) and an outer facing surface 116*b* (e.g., away from a body of a user). The sleeve 112 may further include a plurality of cross-straps 117 (such as two or more, three or more, four or more, etc.) thereby defining the sliding pathway between the plurality of cross-straps 117 and the inner facing surface 116*a* in which the strap 130 may be slidingly positioned. For example, the plurality of cross-straps 117 may be coupled to an inner facing surface 116*a* of the substrate 116. The substrate 116 may be formed of any number of materials, textiles, leather, etc. The cross-straps 117 may be formed of any number of materials including textiles, rubber, leather, elastic materials, etc., or combinations thereof. For example, the cross-straps 117 may be elastic material to aid in passing the strap 130 underneath each cross-strap 117 to be positioned within the sliding pathway.

As noted above, the sleeve 112 may extend between a first end 112*a* and a second end 112*b*. The shoulder harness 110 may further include an underarm strap 118 coupled to or adjacent the first end 112*a* and the second end 112*b*, thereby defining an arm hole 119. The underarm strap 118 may be tapered from where the underarm strap 118 couples to the first end 112*a* (chest portion 113*b*) and/or the second end 112*b* (back portion 113*c*) toward a center of the underarm strap 118, thereby providing increased comfort. The underarm strap 118 may be formed of the same or different material from the substrate 116. In some embodiments, the underarm strap 118 may be elastic, to provide for use across various sized users.

As noted above, the shoulder harness 110 includes one or more pad pockets 111. For example the one or more pad pockets 111 may be formed on the chest portion 113*b*, the back portion 113*c*, or both. For example, one or more pad pockets 111 may be positioned adjacent the first end 112*a* and/or the second end 112*b*, such that when worn, the one or more pad pockets 111 sit on a check and/or a back of the user 200. The one or more pad pockets 111 may protrude outward from the substrate 116 and may have an opening 111*a* and a closure 111*b* for closing the opening 111*a*. For example, the opening 111*a* may be formed along a vertical edge 111*c* of the pad pocket, though other locations are contemplated and possible. The opening 111*a* may provide access into an interior volume of the pad pocket 111. In embodiments, the opening 111*a* is closable by the closure 111*b* which may include, but are not limited to zipper closures, buttons, snaps, Velcro, or the like.

As illustrated, in embodiments, the shoulder harness 110 may include a first pad pocket positioned adjacent the first end 112*a* of the sleeve 112, such as within the chest portion 113*b*, and a second pad pocket positioned adjacent the second end 112*b* of the sleeve 112, such as within the back portion 113*c*. Accordingly, no matter which shoulder a user 200 wears the shoulder harness 110 a pad pocket may be positioned over the chest of the user 200, for recoil pad positioning.

The one or more pad pockets 111 may be any size suitably for holding a recoil pad. In embodiments, the one or more pad pockets 111 may have a length dimension, $l_p$, extending parallel to a vertical axis and a width dimension, $w_p$, extending perpendicular to the vertical axis. In embodiments, the length dimension is longer than the width dimension. For example, the one or more pad pockets 111 may have a size similar to the dimensions of a recoil stock on a firearm, such having a width between about 1.5 inches and about 3 inches and a length between about 4 inches and about 7 inches, though other dimensions are contemplated and possible. The provided dimensions may ensure the recoil pad is sized to correspond to actual engagement with a recoil stock as opposed to a much larger area of conventional recoil pads.

Figure 3:
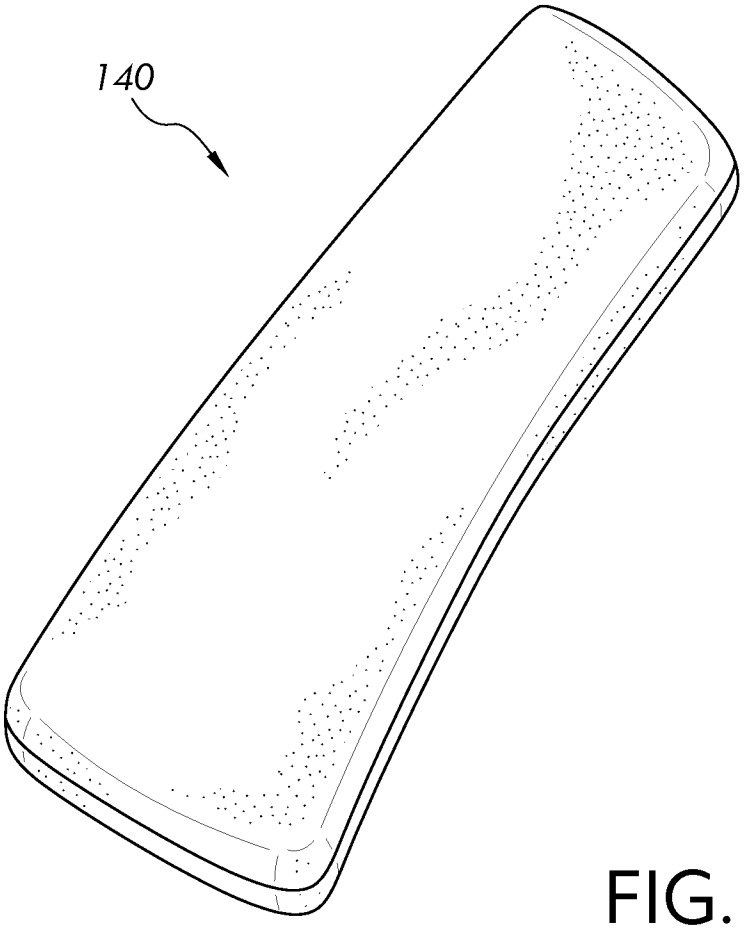
FIG. 3 depicts a recoil pad in isolation from the wearable tactical accessory of FIG. 1A, according to one or more embodiments shown and described herein.

A recoil pad 140 is generally depicted in FIG. 3. The recoil pad 140 may be formed of any suitable material and may have dimensions to fit within the one or more pad pockets 111. In embodiments, the recoil pad 140 may be formed of resin, silicone, rubber, or the like. In embodiments, the recoil pad 140 may be a 3D printed lattice structure comprising one or more layers. Air pockets within the lattice structure may provide additional recoil absorption.

Referring again to FIG. 1A-1B, the strap 130 may be any woven, leather, or polymer elongate substrate, which may be slidingly arranged within the sleeve 112. In embodiments, the strap 130 may include one or more adjustment mechanisms 132 (e.g., adjustment sliders or the like, to adjust the length of the strap 130. In some embodiments, the strap 130 may include one or more buckles 134 which may be used to close the strap 130 in a continuous look. The one or more buckles 134 may include any conventional buckle 134 such as including a female connector portion 134*a* and a male connector portion 134*b*, wherein the male connector portion 134*b* is received within the female connector portion 134*a* to couple the female connector portion 134*a* and the male connector portion 134*b*.

In embodiments, the strap 130 may include two or more portions that are separable from one another. For example, the strap 130 may include a first portion 130*a* and a second portion 130*b*. In embodiments, at least one portion of the strap 130 is length adjustable, such as via an adjustment mechanism 132. In some embodiments both the first portion 130*a* and the second portion 130*b* are length adjustable. The first portion 130*a* may be arranged through the sleeve 112, as illustrated, and the second portion 130*b* may be coupled to the pouch 120. In embodiments, each of the first portion 130*a* and the second portion 130*b* include a buckle 134 have a female connecting portion 134*a* and a male connecting portion 134*b*, so as to provide a first buckle and a second buckle. Accordingly, in embodiments, each of the first portion 130*a* and the second portion 130*b* may be form independent loops. For example, the first portion 130*a* may be formed into an independent, enclosed loop by connecting, for example, the female connecting portion 134*a* of the first portion 130*a* and the male connection portion of the first portion 130*a*. Similarly, the second portion 130*b* may be formed into an independent, enclosed loop by connecting, for example, the female connecting portion 134*a* of the second portion 130*b*, and the male connecting portion 134*b* of the second portion 130*b*. By being able to separate the strap 130 into multiple portions, further utility may be achieved. For example, using only one strap 130, the pouch 120 may be worn independently as a waist pouch 120 (e.g., fanny pack) or as a cross-body 121 for example, without the shoulder harness 110.

Figure 4B:
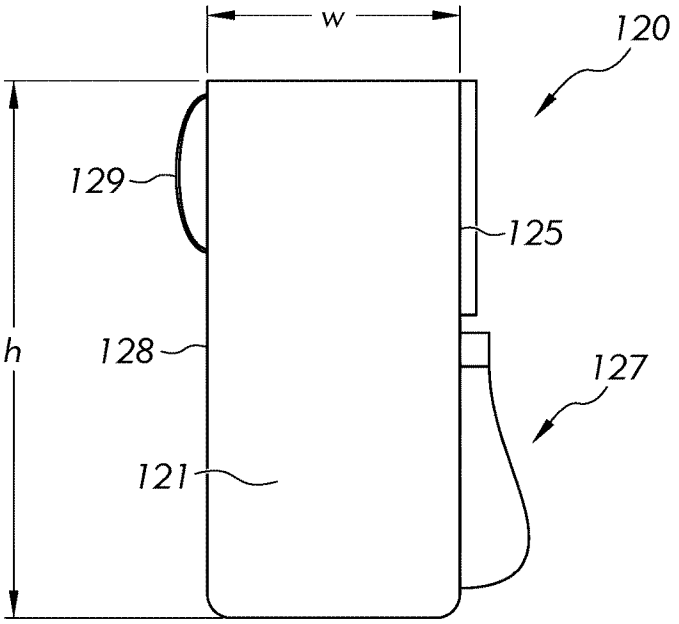
FIG. 4B depicts a side view of the pouch of FIG. 4A, according to one or more embodiments shown and described herein.
Figure 4A:
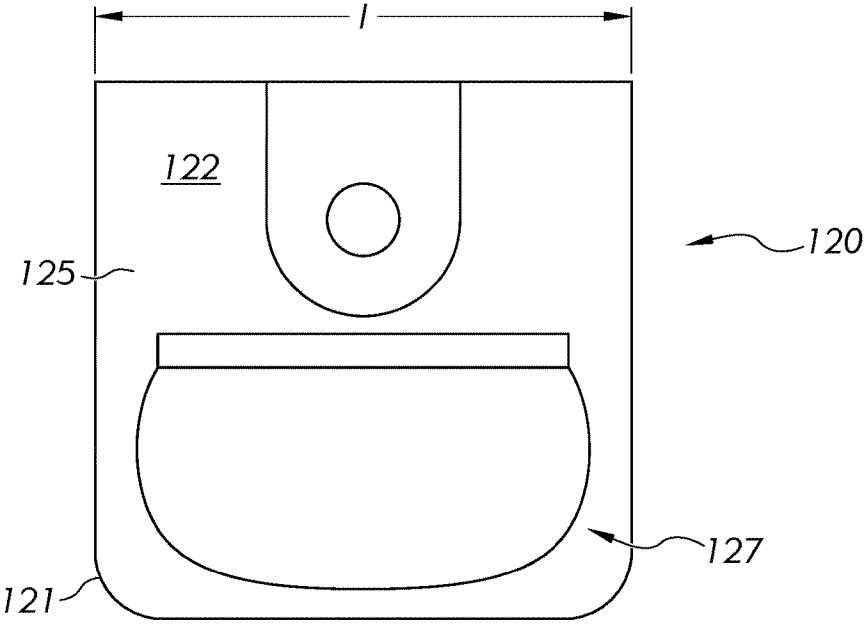
FIG. 4A depicted a front view of the pouch of FIG. 1A, according to one or more embodiments shown and described herein.
Figure 4C:
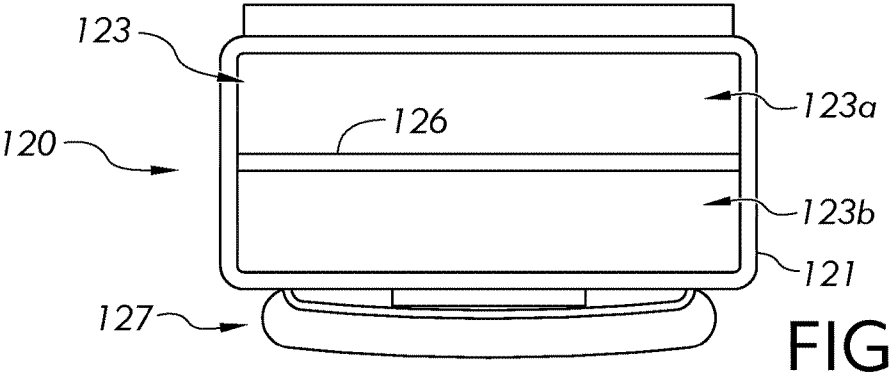
FIG. 4C depicts a top view of the pouch of FIG. 4A, according to one or more embodiments shown and described herein.

Referring now to FIGS. 4A-4C, the pouch 120 may include a body 121 that defines an outer surface 122 of the pouch 120 and an interior volume 123. In embodiments, the pouch 120 or portions thereof may be formed of any combination of leather, textile, polymer, etc. Coupled to the outer surface 122 of the pouch 120, such as at a front wall 125 may be a pocket 127. The pocket 127 in embodiments, may be a mesh or otherwise flexible, which may be useful in holding accessories such as keys, phones, toiletries, etc.

In embodiments, the interior volume 133 may be divided, such as with a divider 126. In the instant embodiment, the divider 126 is arrange parallel to the front wall 125 of the body 121. The divider 126 may be rigid or flexible and divides the interior volume 123 into a first sub volume 123*a* and a second sub volume 123*b*. The first and second sub volumes 123*a*, 123*b* may be equal to one another or be of a different size than one another.

Coupled to the body 121 that as to a back wall 128, opposite from the front wall, may be an attachment loop 129. The attachment loop may be configured to slidingly receive the strap 130, such as the second portion 130*b* of the strap 130, for instance. In embodiments, the attachment loop 129 may be a single loop or multiple loops.

The pouch 120 may be any size suitable for carrying one or more shooting accessories, such as but not limited to, bullets, hand guns, or the like. The pouch 120 may be generally square, rectangular, or any other shape. In embodiments, the pouch 120 includes a width dimension, w, a length dimension, l, and a height dimension, h, wherein the width dimension, w, is smaller than the length dimension, l, or the height dimension, h. In embodiments, the divider 126 extends across the interior volume 123 of the pouch 120 parallel to the length dimension.

Figure 5B:
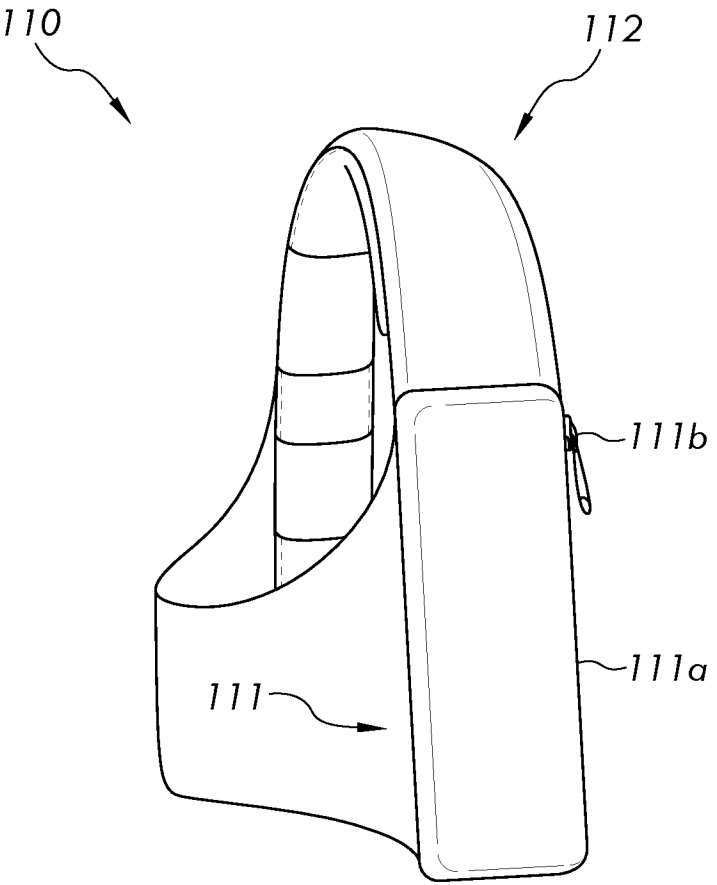
FIG. 5B depicts closer of a zipper closure of the pad pocket of FIG. 5A, according to one or more embodiments shown and described herein.
Figure 5A:
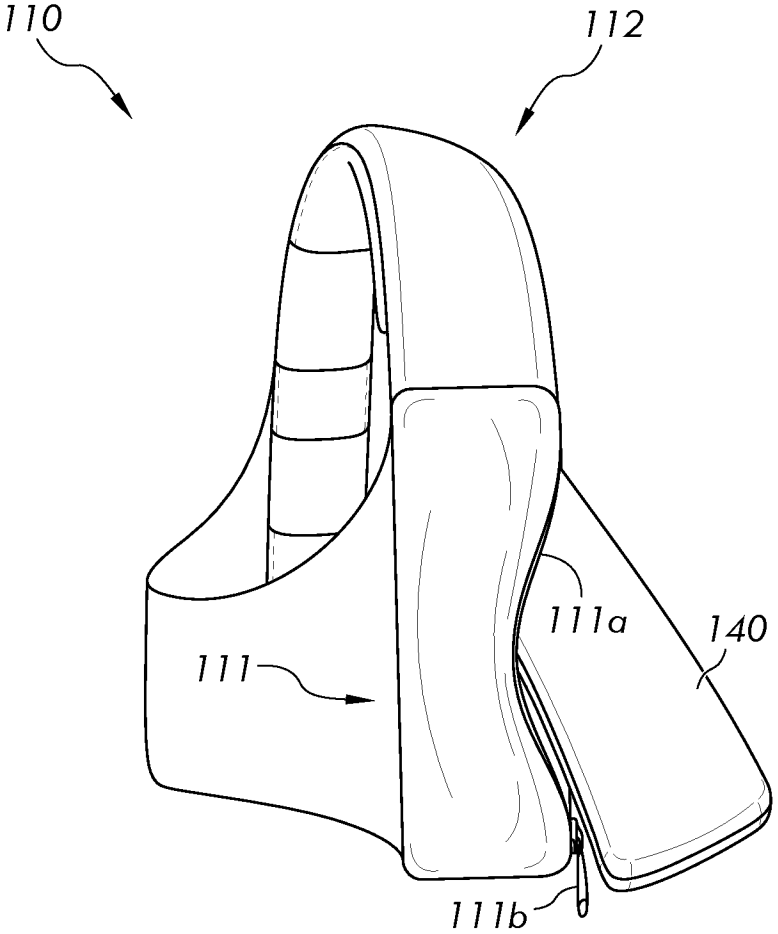
FIG. 5A depicts insertion of a recoil pad into a pad pocket of the shoulder harness of FIG. 1A, according to one or more embodiments shown and described herein.
Figure 5D:
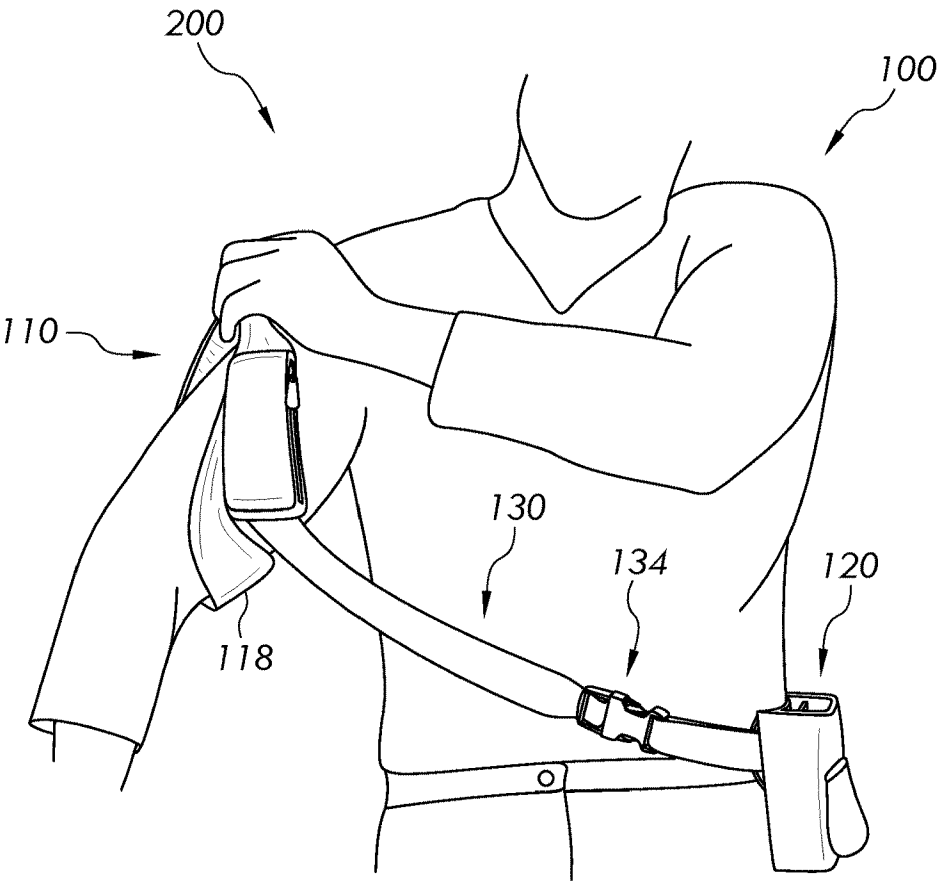
FIG. 5D schematically depicts a user putting on the shoulder harness of FIG. 5A, according to one or more embodiments shown and described herein.
Figure 5C:
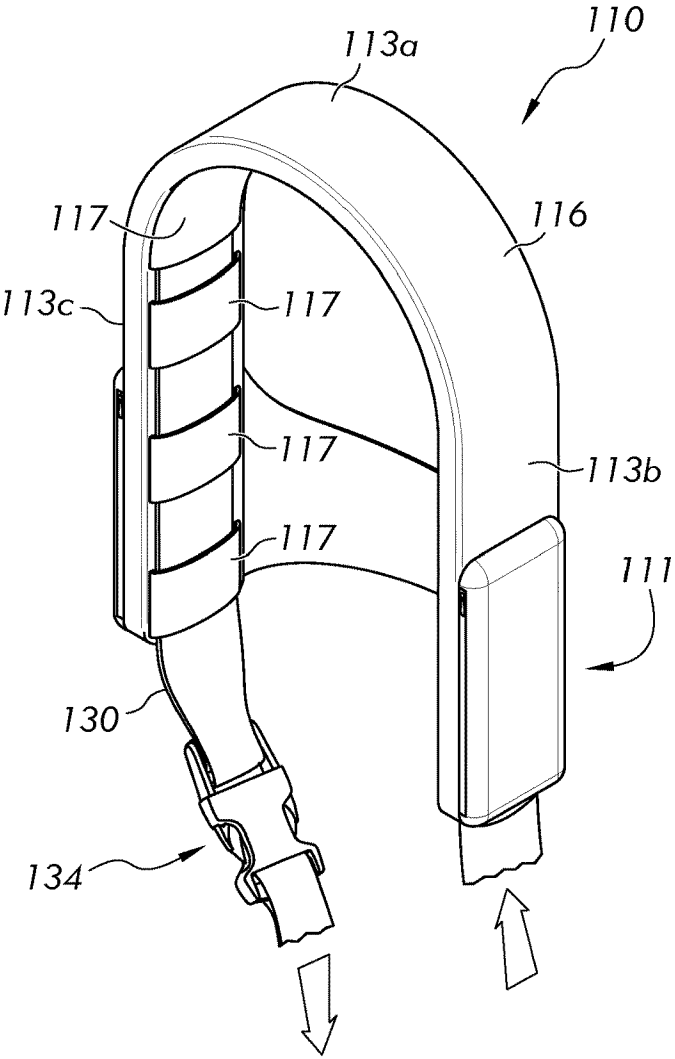
FIG. 5C schematically depicts a user manipulating a strap, according to one or more embodiments shown and describe herein.

Referring to FIG. 5A-5D assembly of the wearable tactical accessory 100 such as for performing a shooting activity is schematically depicted. As illustrated in FIG. 5A, the recoil pad 140 may be inserted into the desired pocket 111. As illustrated in FIG. 5B, the pad pocket 111 may be closed such as via a zipper closure as shown, though other devices are contemplated and possible. FIG. 5C schematically illustrates pulling by a user 200 of the strap 130 through the guides of the shoulder harness 1110 or the pouch 120 guides (e.g., cross straps or attachment loop, respectively). For example, one or more of the buckles 134 may be undone to allow for an end of the strap 130 to be guided into position within the shoulder harness 110 and/or pouch 120.

Referring now to FIG. 5D illustrates a user 200 putting on the wearable tactical accessory 100. For example, the user 200 may arrange the pouch 120 and strap 130 across their torso 402 such that the pouch 120 lays adjacent a user's hip, for example. The user 200 may arrange their arm through the arm hole 119 on an opposite shoulder such that the recoil pad is positioned on a chest of the user 200. As described above the shoulder portion 113*a* may sit on top of the user's shoulder 204, the chest portion 113*b* which extends from the shoulder 204 down onto the user's chest 202, and the back portion 113*c* which extends from the shoulder portion 113*a* down onto the user's back 206. As noted above, the pocket 111 and/or the chest portion 113*b*, may be sized to be positioned above a user's bust-line 208, as illustrated, thereby avoiding a largest dimension of the user's chest. Such dimensions may assist in preventing the sleeve 112 from overlying a largest dimension of, for example, a woman's bust line, which may increase comfort particularly for female or other users having breast tissue or breasts. However, other configurations are possible as noted above.

In embodiments, and as noted herein, the shoulder harness 110 may be ambidextrous top allow the shoulder harness 110 to be worn on the opposite shoulder if desired. In such configurations, the pouch 120 would switch to the opposite hip with the front wall.

Embodiments may be further described with respect to the following numbered clauses:

1. A wearable tactical accessory, comprising: a shoulder harness comprising one or more pad pockets; a pouch; a strap removably coupling the shoulder holster and the pouch; and a recoil pad sized to be removably positioned within the one or more pad pockets.
2. The wearable tactical accessory of clause 1, wherein the shoulder harness comprises a sleeve configured to slidingly receive the strap.
3. The wearable tactical accessory of clause 2, wherein the sleeve comprises a substrate and a plurality of cross-straps defining a sliding pathway in which the strap is slidingly positioned.
4. The wearable tactical accessory of clause 2 or 3, wherein: the sleeve extends between a first end and a second end; and the shoulder harness comprises an underarm strap coupled to the first end and the second of the sleeve thereby defining an arm hole.

5. The wearable tactical accessory of any preceding clause, wherein the shoulder harness comprises a sleeve extending between a first end and a second end and the one or more pad pockets are positioned adjacent the first end and the second end such that when worn, the one or more pad pockets sit on a chest or back of a user.
6. The wearable tactical accessory of clause 5, wherein the one or more pad pockets comprise a first pad pocket positioned adjacent the first end and a second pad pocket positioned adjacent the second end.
7. The wearable tactical accessory of any preceding clause, wherein the one or more pad pockets comprise a zipper closure.
8. A wearable tactical accessory, comprising: a shoulder harness comprising one or more pad pockets; a pouch; a strap removably coupling the shoulder holster and the pouch via one or more buckles; and a recoil pad sized to be removably positioned within the one or more pad pockets.
9. The wearable tactical accessory of clause 8, wherein the one or more buckles comprise a first buckle arranged and a second buckle, such that the strap is dividable into two portions via release of the first buckle and the second buckle.
10. The wearable tactical accessory of clause 9, wherein each portion of the strap comprises a male connecting portion of either the first buckle or the second buckle and a female connecting portion of the other of the first buckle and the second buckle, such that each portion of the strap is closable in a separate loop.
11. The wearable tactical accessory of clause 9 or 10, wherein at least one portion of the strap is length adjustable.
12. The wearable tactical accessory of any preceding clause, wherein the shoulder harness comprises a sleeve configured to slidingly receive the strap.
13. The wearable tactical accessory of clause 12, wherein the sleeve comprises a substrate and a plurality of cross-straps defining a sliding pathway in which the strap is slidingly positioned.
14. The wearable tactical accessory of clause 12 or 13, wherein: the sleeve extends between a first end and a second end; and the shoulder harness comprises an underarm strap coupled to the first end and the second of the sleeve thereby defining an arm hole.
15. The wearable tactical accessory of any preceding clause, wherein the shoulder harness comprises a sleeve extending between a first end and a second end and the one or more pad pockets are positioned adjacent the first end and the second end such that, when worn, the one or more pad pockets sit on a chest or back of a user.
16. A wearable tactical accessory, comprising: a shoulder harness comprising one or more pad pockets; a pouch comprising a divider dividing a volume of the pouch into a first sub volume and a second sub volume; a strap removably coupling the shoulder holster and the pouch; and a recoil pad sized to be removably positioned within the one or more pad pockets.
17. The tactical accessory of clause 16, wherein the pouch comprises a width dimension, a length dimension, and a height dimension, wherein the width dimension is smaller than the width dimension or the height dimension and the divider extends across the volume of the pouch parallel to the length dimension.
18. wearable The tactical accessory of any preceding clause, wherein the pouch comprises a front wall and a pocket outwardly from the front wall.
19. The tactical accessory of clause 17 or 18, wherein the pouch comprises a back wall and an attachment loop extending outwardly from the back wall, wherein the strap is slidably positioned within the attachment loop.
20. The tactical accessory of any preceding clause, wherein the shoulder harness comprises a sleeve extending between a first end and a second end and the one or more pad pockets comprise a first pad pocket positioned adjacent the first end and a second pad pocket positioned adjacent the second end.

It should now be understood that embodiments of the present disclosure are directed to wearable tactical accessories. In particular, the wearable tactical accessories as disclosed herein generally include a shoulder harness, a pouch, and a strap that couples the shoulder harness to the pouch. In embodiments, the shoulder harness includes one or more pad pockets which allows a user removably insert a removable recoil pad. The recoil pad may be smaller than traditional recoil pads and may be positioned by the shoulder harness to provide improved comfort. Moreover, as the recoil pad is removable, the wearable tactical accessory allows for improved versatility and use.

It is noted that the terms "substantially" and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A wearable tactical accessory configured for receiving a recoil force of a gun, comprising:

a shoulder harness comprising a first pad pocket and a second pad pocket, the shoulder harness having a first end adjacent a bottom of the first pad pocket and a second end adjacent a bottom of the second pad pocket;

a pouch;

a strap removably coupling the shoulder harness and the pouch, the strap preceding from the shoulder harness adjacent the first end and the second end; and a recoil pad configured to receive the recoil force from the gun, the recoil pad sized to be removably positioned interchangeably within the first pad pocket and the second pad pocket;

wherein the wearable tactical accessory includes:

a first configuration in which the recoil pad is within the first pad pocket and the first pad pocket is positioned over a chest of a user so as to position the recoil pad to receive and at least partially absorb the recoil force of a firearm; and a second configuration in which the recoil pad is within the second pad pocket and the second pad pocket is positioned over the chest of the user so as to position the recoil pad to receive and at least partially absorb the recoil force of the firearm, wherein a total length of the shoulder harness between the first end and the second end is between 14 inches and 24 inches, such that when in the first configuration, the first pad pocket and the first end are positioned above a largest dimension of a user's bustline, and when in the second configuration the second pad pocket and the second end are positioned above the largest dimension of the user's bustline;

wherein the recoil pad comprises a first end and a second end opposite the first end, wherein the second end is larger than the first end and at least one side extending between the first end and the second end is concave.

2. The wearable tactical accessory of claim 1, wherein the shoulder harness comprises a sleeve configured to slidingly receive the strap.

3. The wearable tactical accessory of claim 2, wherein the sleeve comprises a substrate and a plurality of cross-straps defining a sliding pathway in which the strap is slidingly positioned.

4. The wearable tactical accessory of claim 2, wherein:

the sleeve extends between a first end and a second end; and the shoulder harness comprises an underarm strap coupled to the first end and the second end of the sleeve thereby defining an arm hole.

5. The wearable tactical accessory of claim 1, wherein the shoulder harness comprises a sleeve extending between a first end and a second end and the first pad pocket is positioned adjacent the first end and the second pad pocket is positioned adjacent the second end such that when worn in the first configuration, the first pad pocket sits on the chest of the user and the second pad pocket sits on a back of the user.

6. The wearable tactical accessory of claim 1, wherein the first pad pocket or the second pad pocket comprise a zipper closure.

7. A wearable tactical accessory configured for receiving a recoil force of a gun, comprising:

a shoulder harness comprising a first pad pocket and a second pad pocket, the shoulder harness having a first end adjacent a bottom of the first pad pocket and a second end adjacent a bottom of the second pad pocket;

a pouch;

a strap removably coupling the shoulder harness and the pouch via one or more buckles, the strap preceding from the shoulder harness at the first end and the second end; and a recoil pad configured to receive the recoil force from the gun, the recoil pad sized to be removably positioned interchangeably within the first pad pocket and the second pad pocket;

wherein the wearable tactical accessory includes:

a first configuration in which the recoil pad is within the first pad pocket and the first pad pocket is positioned over a chest of a user so as to position the recoil pad to receive and at least partially absorb the recoil force of a firearm; and a second configuration in which the recoil pad is within the second pad pocket and the second pad pocket is positioned over the chest of the user so as to position the recoil pad to receive and at least partially absorb the recoil force of the firearm, wherein a total length of the shoulder harness between the first end and the second end is between 14 inches and 24 inches, such that when in the first configuration, the first pad pocket and the first end are positioned above a largest dimension of a user's bustline, and when in the second configuration the second pad pocket and the second end are positioned above the largest dimension of the user's bustline;

wherein the recoil pad comprises a first end and a second end opposite the first end, wherein the second end is larger than the first end and at least one side extending between the first end and the second end is concave.

8. The wearable tactical accessory of claim 7, wherein the one or more buckles comprise a first buckle and a second buckle, such that the strap is dividable into two portions via release of the first buckle and the second buckle.

9. The wearable tactical accessory of claim 8, wherein each portion of the strap comprises a male connecting portion of either the first buckle or the second buckle and a female connecting portion of the other of the first buckle and the second buckle, such that each portion of the strap is closable in a separate loop.

10. The wearable tactical accessory of claim 8, wherein at least one portion of the strap is length adjustable.

11. The wearable tactical accessory of claim 7, wherein the shoulder harness comprises a sleeve configured to slidingly receive the strap.

12. The wearable tactical accessory of claim 11, wherein the sleeve is configured to go over a user's shoulder and comprising:

reversible chest and back portions, each comprising a pad pocket positioned on an outer surface of the sleeve; and a plurality of cross-straps positioned on an inner surface of the sleeve defining a sliding pathway aligned beneath the pad pockets in which the strap is slidingly positioned.

13. The wearable tactical accessory of claim 11, wherein:

the sleeve extends between a first end and a second end; and the shoulder harness comprises an underarm strap coupled to the first end and the second end of the sleeve thereby defining an arm hole.

14. The wearable tactical accessory of claim 7, wherein the shoulder harness comprises a sleeve extending between a first end and a second end and the first pad pocket is positioned adjacent the first end and the second pad pocket is positioned adjacent the second end such that when worn in the first configuration, the first pad pocket sits on the chest of the user and the second pad pocket sits on a back of the user.

15. A wearable tactical accessory configured for receiving a recoil force of a gun, comprising:

a shoulder harness comprising a first pad pocket positioned on a chest portion of the shoulder harness and a second pad pocket positioned on a back portion of the shoulder harness, the shoulder harness having a first end adjacent a bottom of the first pad pocket and a second end adjacent a bottom of the second pad pocket;

a pouch comprising a divider dividing a volume of the pouch into a first sub volume and a second sub volume;

a strap removably coupling the shoulder harness and the pouch, the strap preceding from the shoulder harness adjacent the first end and the second end; and a recoil pad configured to receive the recoil force from the gun, the recoil pad sized to be removably and interchangeably positioned within the first pad pocket or the second pad pocket;

wherein the wearable tactical accessory includes:

a first configuration in which the recoil pad is within the first pad pocket and the first pad pocket is positioned over a chest of a user so as to position the recoil pad to receive and at least partially absorb the recoil force of a firearm; and a second configuration in which the recoil pad is within the second pad pocket and the second pad pocket is positioned over the chest of the user so as to position the recoil pad to receive and at least partially absorb the recoil force of the firearm, wherein a total length of the shoulder harness between the first end and the second end is between 14 inches and 24 inches, such that when in the first configuration, the first pad pocket and the first end are positioned above a largest dimension of a user's bustline, and when in the second configuration the second pad pocket and the second end are positioned above the largest dimension of the user's bustline;

wherein the recoil pad comprises a first end and a second end opposite the first end, wherein the second end is larger than the first end and at least one side extending between the first end and the second end is concave.

16. The wearable tactical accessory of claim 15, wherein the pouch comprises a front wall and a pocket extending outwardly from the front wall.

17. The wearable tactical accessory of claim 15, wherein the pouch comprises a back wall and an attachment loop extending outwardly from the back wall, wherein the strap is slidably positioned within the attachment loop.

18. The wearable tactical accessory of claim 15, wherein the shoulder harness comprises a sleeve extending between a first end and a second end and the first pad pocket is positioned adjacent the first end and the second pad pocket is positioned adjacent the second end.

* * * * *